US007038380B2

(12) United States Patent
Hsu

(10) Patent No.: US 7,038,380 B2
(45) Date of Patent: May 2, 2006

(54) THREE PHASE LIGHT BULB

(75) Inventor: Chin-Shui Hsu, Hsinchu (TW)

(73) Assignee: Everlite Electric Industries Corp., Hsinchu (TW)

( * ) Notice: Subject to any disclaimer, the term of this patent is extended or adjusted under 35 U.S.C. 154(b) by 168 days.

(21) Appl. No.: 10/837,657

(22) Filed: May 4, 2004

(65) Prior Publication Data

US 2005/0248251 A1 Nov. 10, 2005

(51) Int. Cl.
*H01K 1/16* (2006.01)
*H01K 9/00* (2006.01)

(52) U.S. Cl. ..... 313/578; 313/272; 313/318.01

(58) Field of Classification Search ..... 313/578, 313/272, 343, 318.01
See application file for complete search history.

(56) References Cited

U.S. PATENT DOCUMENTS 2,100,195 A * 11/1937 Lowry ..... 327/598
4,654,560 A * 3/1987 Cote ..... 315/49
4,912,364 A * 3/1990 Hollo et al. ..... 313/623
6,919,684 B1 * 7/2005 Brandes ..... 313/578

* cited by examiner

*Primary Examiner*—Karabi Guharay
(74) *Attorney, Agent, or Firm*—Rosenberg, Klein & Lee

(57) ABSTRACT

A light bulb includes a seat having a first engaging point and a first contact point respectively formed on a bottom face of the seat to correspond to a second engaging point and a second contact point of a light bulb socket. A first end of the first wire engages with the first engaging point of the seat and a second end thereof engages with a first end of a first filament received in the second enclosure. A first end of the second wire engages with the second engaging point of the seat and a second end thereof engages with a first end of a second filament received in the third enclosure. The third wire has a first end engaging with a side wall of the seat and a second end engaging with both second ends of the first and second filaments.

1 Claim, 7 Drawing Sheets

THREE PHASE LIGHT BULB

BACKGROUND OF THE INVENTION

1. Field of the Invention

The present invention relates to a light bulb, and more particularly to a three-phase light bulb having three different lighting effects so as to provide light to meet different requirements.

2. Description of Related Art

Conventional light bulbs are each normally equipped with a seat having an engaging area formed on a bottom of the seat, two conducting wires respectively extending out from the engaging area and into an enclosure to connect to different ends of a filament received inside the enclosure. Thus, the user is able to use the light bulb to give off light to illuminate a space. However, because the dimension of the filament is fixed, the brightness of the light is fixed. Therefore, if the brightness is insufficient for the entire space, the user can only replace the light bulb with a different light bulb having a filament with a larger dimension than the dimension of the original light bulb. Again, after the filament is changed by using a different light bulb, the brightness of the light is also fixed so that if the illumination requirement is changed again and not much illumination is required, the user will have to change back to the original light bulb. Although changing the light bulb is not particularly difficult, the potential risks including falling to the ground, slipping . . . etc., may result in injury to the user. Above all, the work is annoying and tiresome.

To overcome the shortcomings, the present invention tends to provide an improved three-phase light bulb to mitigate the aforementioned problems.

SUMMARY OF THE INVENTION

The primary objective of the present invention is to provide an improved three-phase light bulb to give off three different brightnesses of light in accordance with requirements.

Other objects, advantages and novel features of the invention will become more apparent from the following detailed description when taken in conjunction with the accompanying drawings.

DETAILED DESCRIPTION OF THE PREFERRED EMBODIMENT

Figure 1:
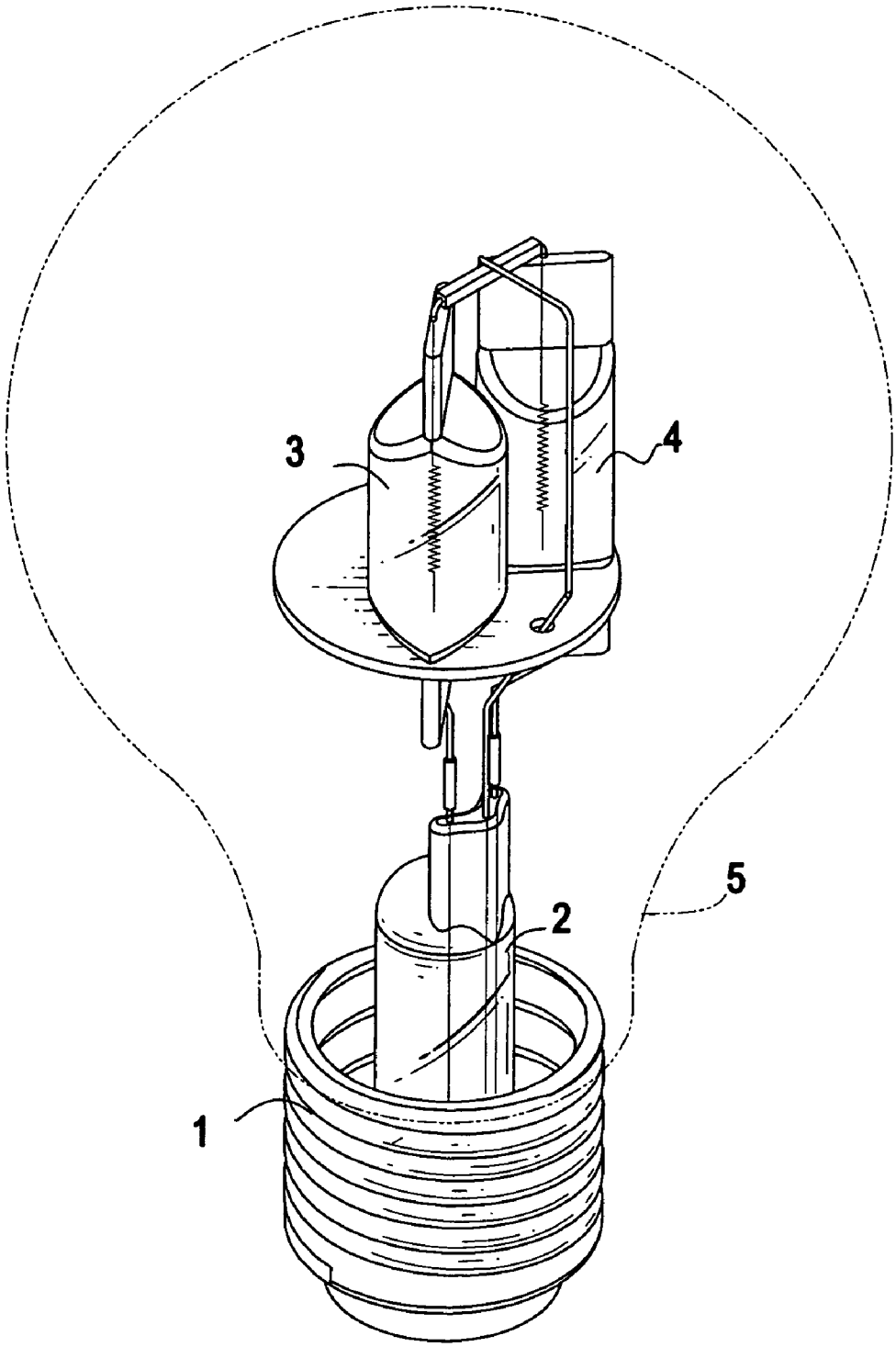
FIG. 1 is a perspective view of the light bulb of the present invention.
Figure 2:
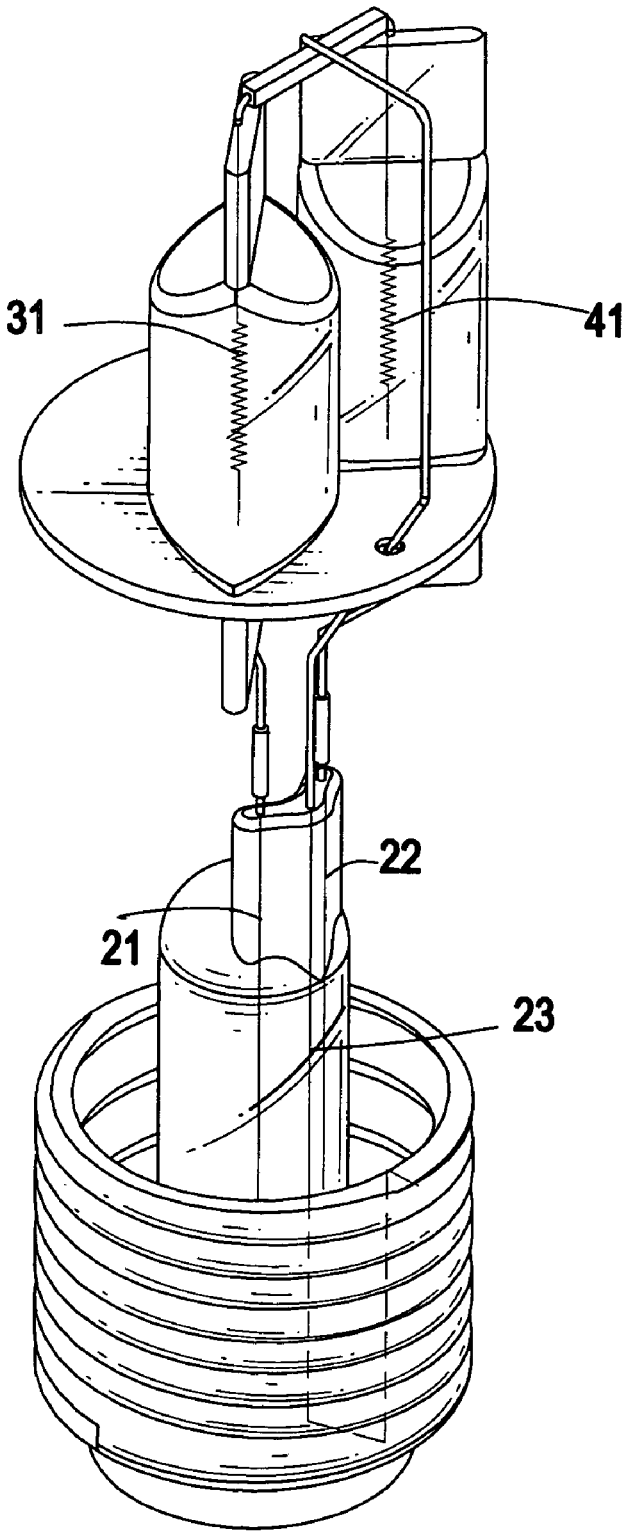
FIG. 2 is a perspective view of the light bulb with the glass cover being removed.
Figure 3:
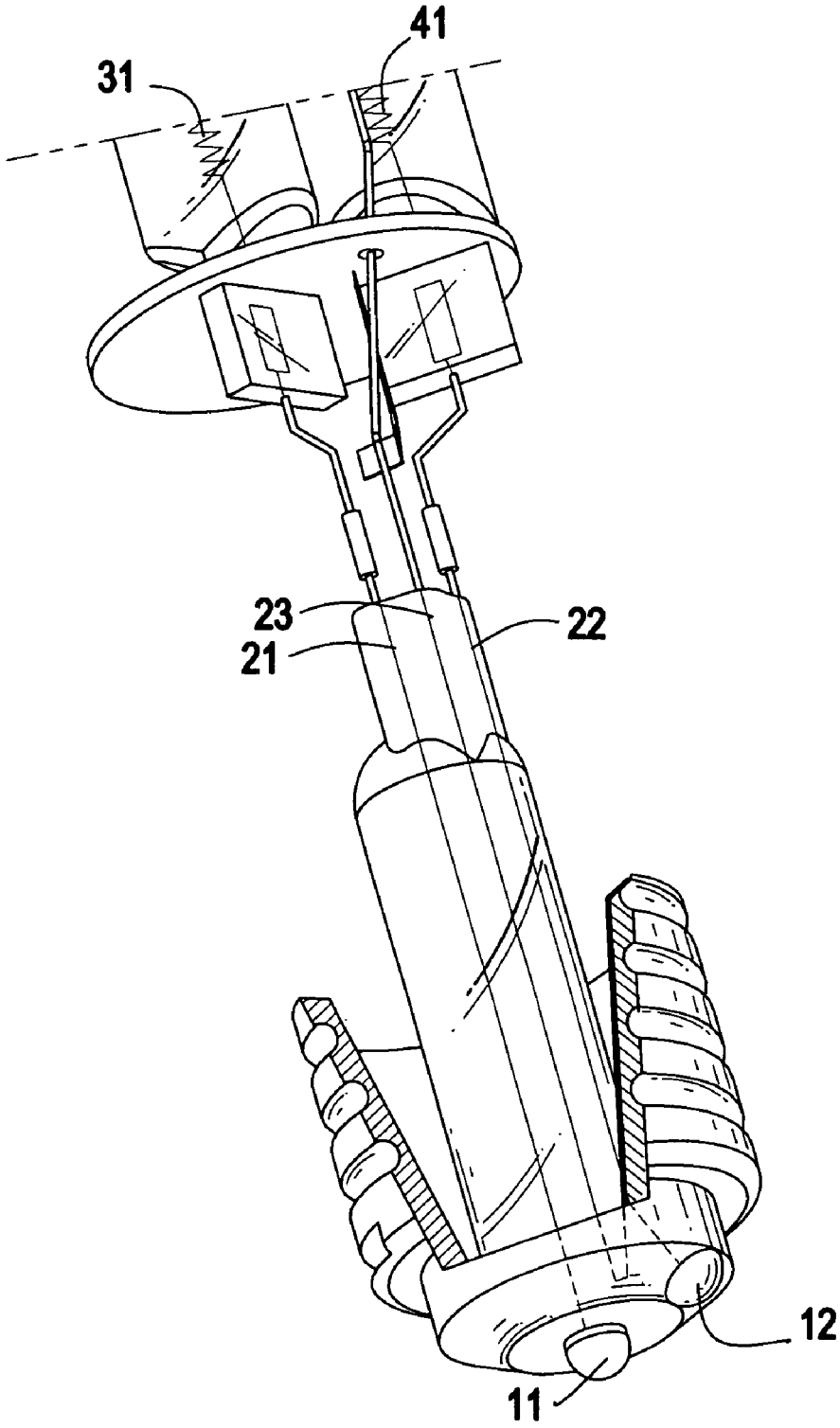
FIG. 3 is a perspective view of the light bulb in partial cross-section.
Figure 4:
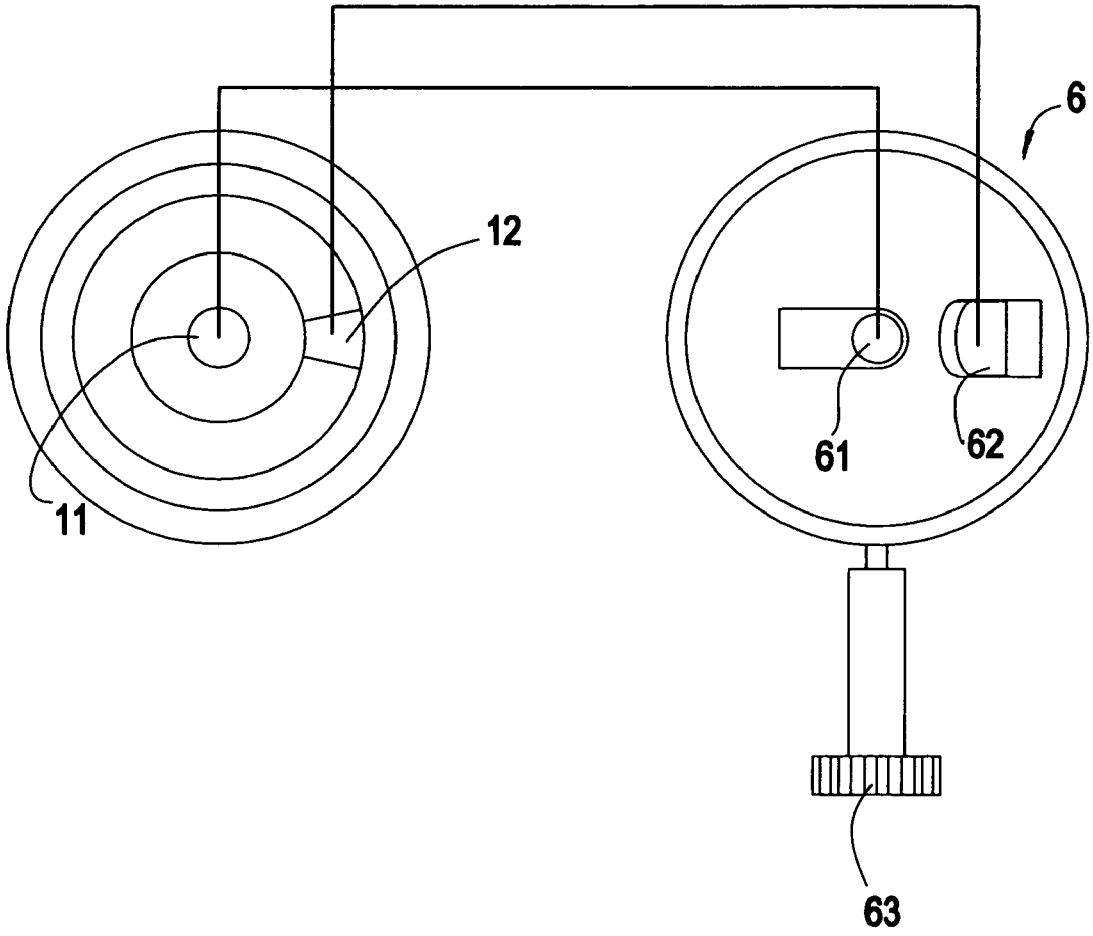
FIG. 4 is a bottom view showing the mutual corresponding relationship between the light bulb of the present invention and the light bulb socket.

With reference to FIGS. 1, 2, 3 and 4, the light bulb in accordance with the present invention includes a seat (1), a first enclosure (2), a second enclosure (3), a third enclosure (4) and a glass cover (5) enclosing the first, second and third enclosures (2,3,4) and hermetically connected to the seat (1).

The seat (1) has a first engaging point (11) and a first contact point (12) respectively formed on a bottom face of the seat (1) to correspond to a second engaging point (61) and a second contact point (62) of a light bulb socket (6).

The first enclosure (2) is securely formed on the bottom face of the seat (1) and has first, second and third wires (21,22,23) extending out from the first enclosure (2). The first wire (21) has a first end which engages with the first engaging point (11) of the seat (1) and a second end which engages with a first end of a first filament (31) received in the second enclosure (3). The second wire (22) has a first end which engages with the first contact point (12) of the seat (1) and a second end which engages with a first end of a second filament (41) received in the third enclosure (4). The third wire (23) has a first end which engages with a side wall of the seat (1) and a second end which engages with both second ends of the first and second filaments (31,41). Thus a complete circuit is accomplished inside the bulb of the present invention.

Figure 5:
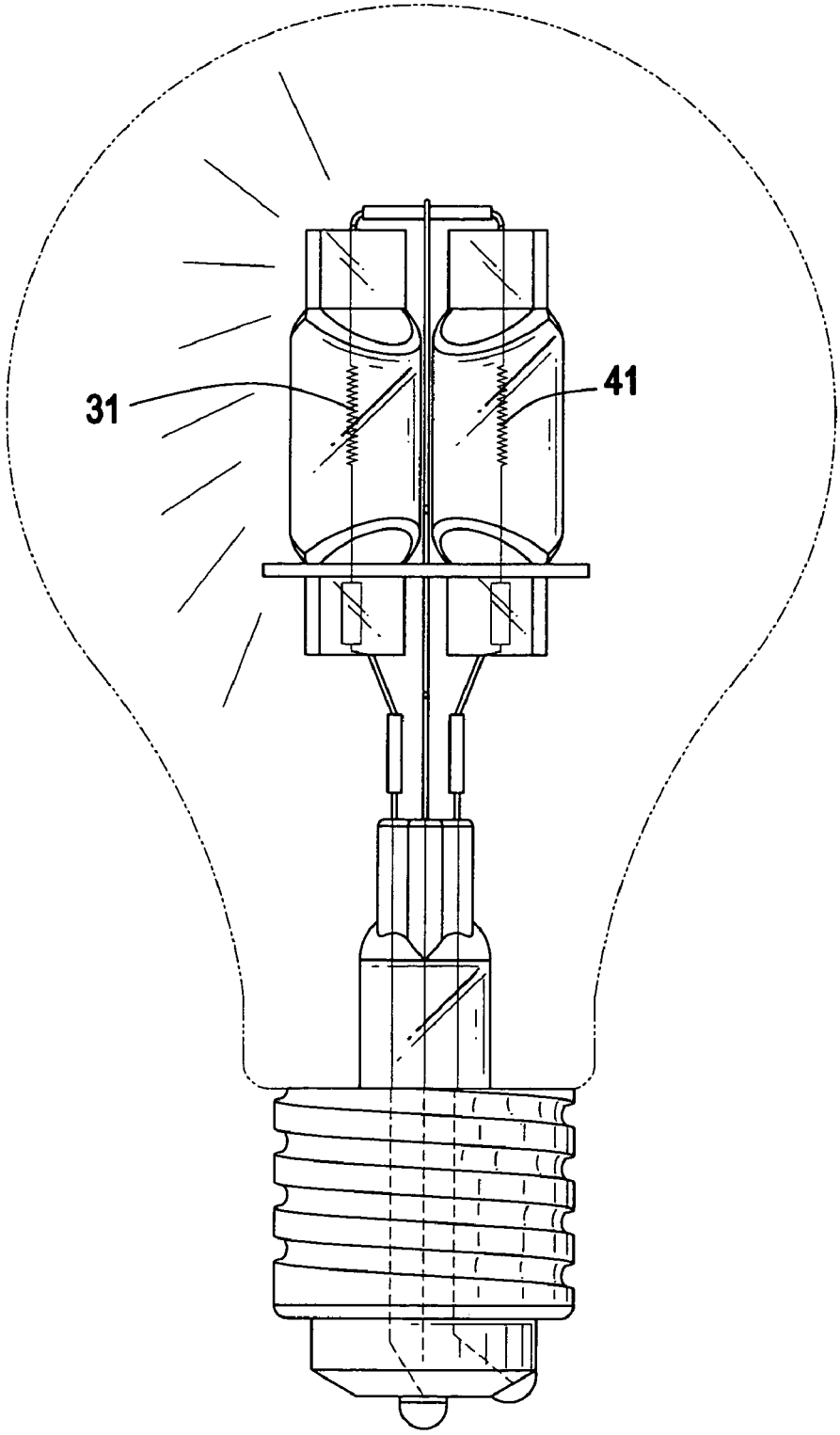
FIGS. 5–7 are schematic views showing that different brightnesses are given off by lighting different filaments.
Figure 6:
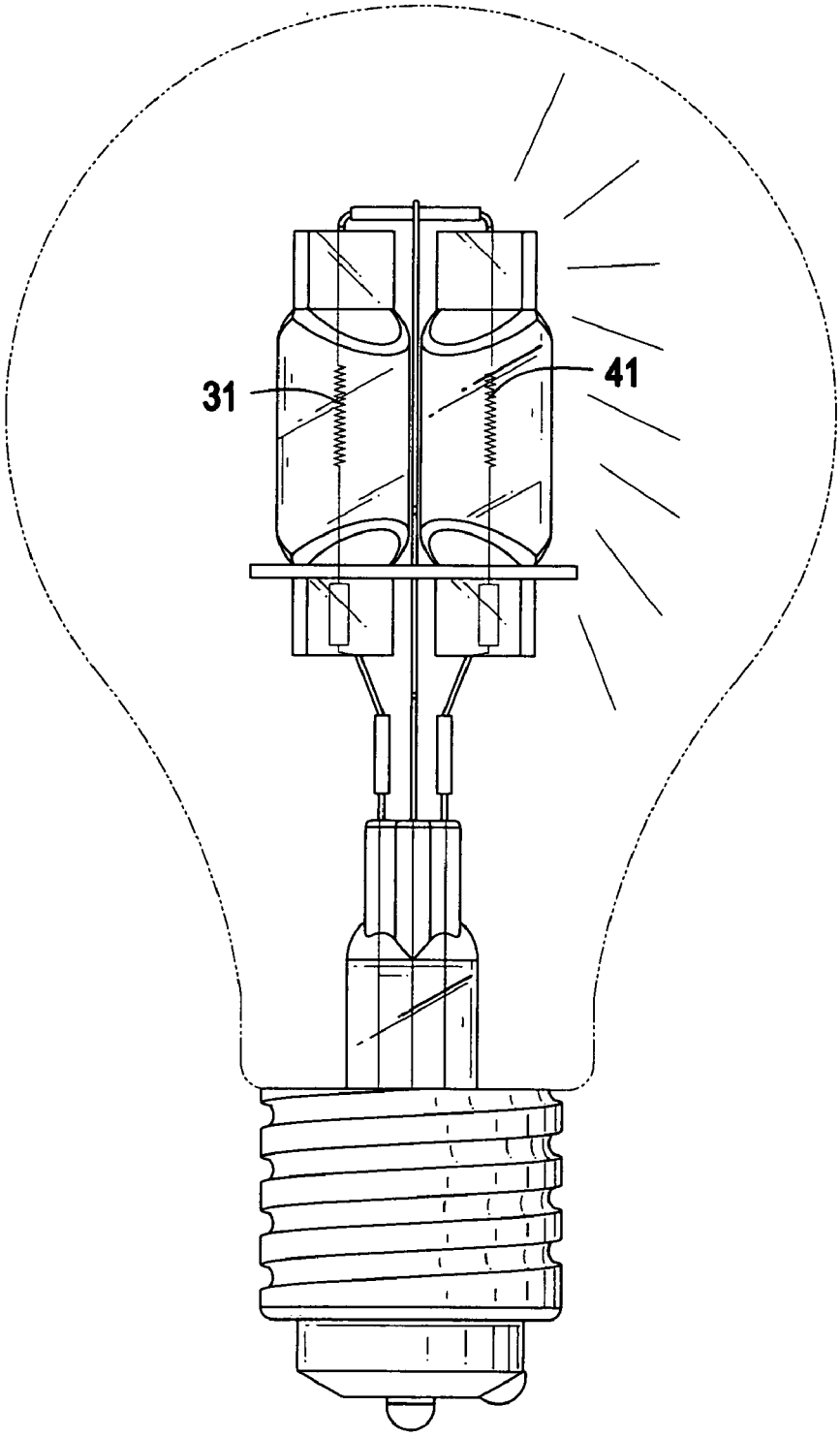
Figure 7:
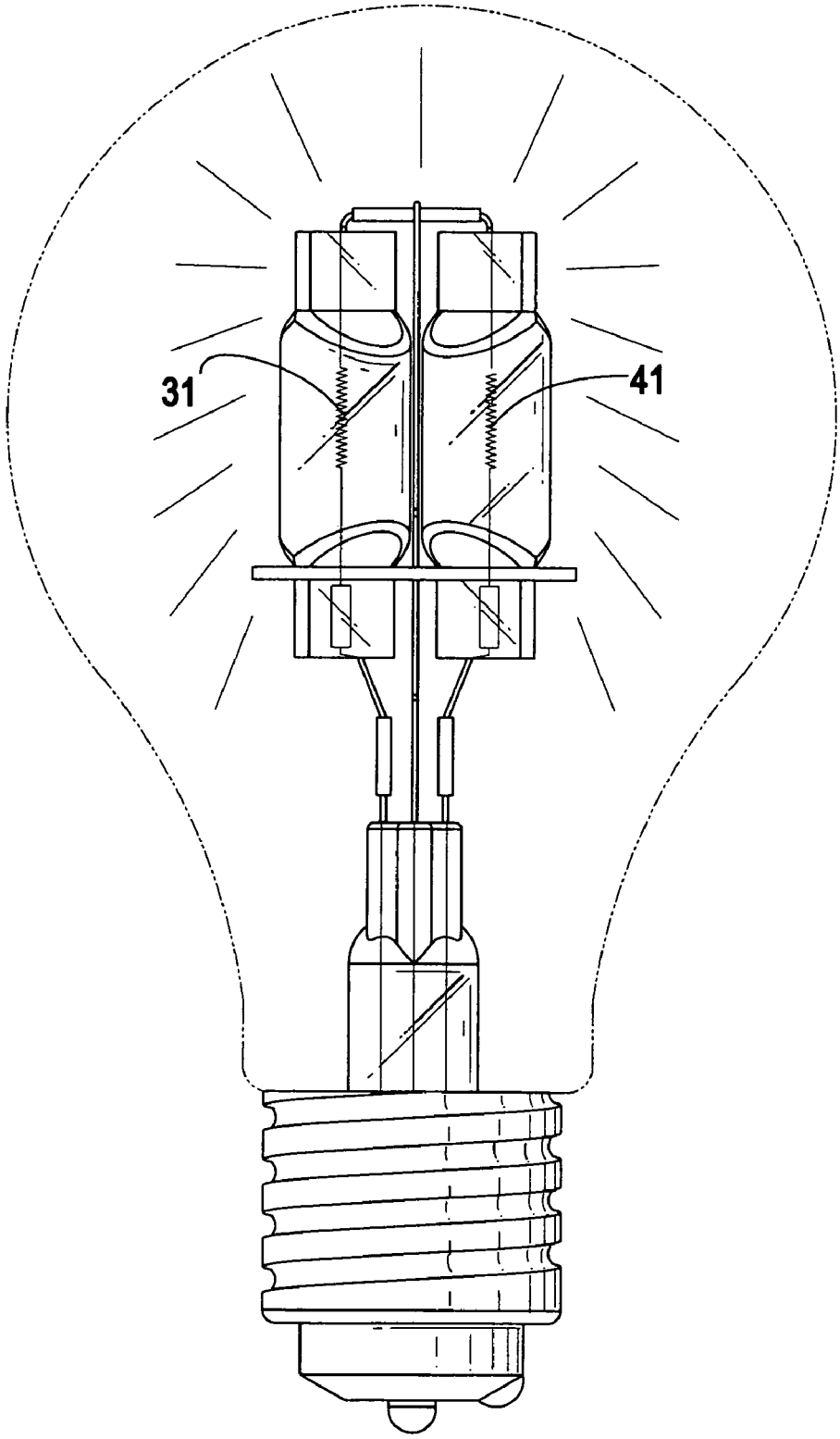

With reference to FIGS. 4–7, it is noted that with the operation of the light bulb socket (6), the first filament (31) is lit when a switch (63) on the light bulb socket (6) is rotated once. Then the second filament (41) is lit when the switch (63) is rotated twice. When the switch (63) is rotated thrice, both the first and second filaments (31,41) are lit to send out maximum brightness.

In the preferred embodiment of the referenced application, the first filament (31) is 50 W and the second filament (41) is 100 W. Therefore, when both the first and second filaments (31,41) are lit, 150 W energy is generated by the first and second filaments (31,41) and the brightness given off by the light bulb of the present invention is maximum.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light bulb comprising a seat (1), a first enclosure (2), a second enclosure (3), a third enclosure (4) and a glass cover (5) enclosing the first, second and third enclosure (2,3,4) and hermetically connected to the seat (1), wherein the seat (1) has a first engaging point (11) and a first contact point (12) respectively formed on a bottom face of the seat (1) for corresponding to a second engaging point (61) and a second contact point (62) of a light bulb socket (6), the first enclosure (2) is securely formed on the bottom face of the seat (1) and has first, second and third wires (21,22,23) extending out from the first enclosure (2), the first wire (21) has a first end which engages with the first engaging point (11) of the seat (1) and a second end which engages with a first end of a first filament (31) received in the second enclosure (3), the second wire (22) has a first end which engages with the first contact point (12) of the seat (1) and a second end which engages with a first end of a second filament (41) received in the third enclosure (4), the third wire (23) has a first end of which engages with a side wall of the seat (1) and a second end which engages with both second ends of the first and second filaments (31,41).

* * * * *